US005209030A

United States Patent [19]

Sloditskie et al.

[11] Patent Number: 5,209,030

[45] Date of Patent: May 11, 1993

[54] PREFABRICATED MODULAR HOUSING UNIT HAVING A COLLASIBLE DORMER

[75] Inventors: Gregory J. Sloditskie; Paul R. John, both of Winfield; Paul D. John, Mifflinburg; Robert J. Roney, Danville, all of Pa.

[73] Assignee: Ritz-Craft Corp., Mifflinburg, Pa.

[21] Appl. No.: 667,736

[22] Filed: Mar. 11, 1991

[51] Int. Cl.[5] ..... E04B 1/36; E04B 1/344; E04B 1/348

[52] U.S. Cl. ..... 52/79.5; 52/745.11; 52/745.20

[58] Field of Search ..... 29/525.1, 428, 469; 52/741, 745, 90, 79.5, 71, 641, 68-70, 79.5, 67

[56] References Cited

U.S. PATENT DOCUMENTS

| | | | |
|---|---|---|---|
| 29,600 | 3/1884 | Evesson | 52/64 |
| 960,207 | 5/1910 | Slater | 52/143 |
| 1,417,736 | 5/1922 | Heygate | 52/69 |
| 2,350,904 | 6/1944 | King | 52/64 |
| 2,701,038 | 2/1955 | Mooney | 52/69 |
| 2,724,152 | 11/1955 | Massano | 52/62 |
| 2,762,084 | 9/1956 | Singer | 52/64 |
| 3,281,998 | 11/1966 | Honold et al. | 52/66 |
| 3,296,752 | 1/1967 | Philp | 52/70 |
| 3,404,496 | 10/1968 | Ballard | 52/641 |
| 3,442,057 | 5/1969 | Derr | 52/90 |
| 3,593,471 | 7/1971 | Fields | 52/79.5 |
| 3,605,355 | 9/1971 | Solesbee | 52/641 |
| 3,653,165 | 4/1972 | West | 52/71 |
| 3,699,731 | 10/1972 | Arnold | 52/64 |
| 3,736,708 | 6/1973 | Chapman | 52/69.5 |
| 3,739,536 | 6/1973 | Ward | 52/63 |
| 3,890,747 | 6/1975 | Van Der Lely | 52/64 |
| 3,971,185 | 7/1976 | Hendrich | 52/745 |
| 3,983,665 | 10/1976 | Burton | 52/79.5 |
| 4,027,912 | 6/1977 | Pacca | 296/23 |
| 4,070,804 | 1/1978 | Van der Lely | 52/64 |
| 4,162,595 | 7/1979 | Ramos et al. | 52/69 |
| 4,742,653 | 5/1988 | Napier et al. | 52/66 |
| 4,815,242 | 3/1989 | Gilliland | 52/90 |
| 4,891,919 | 1/1990 | Palibroda | 52/79.5 |
| 4,926,591 | 5/1990 | Buijs | 52/63 |

FOREIGN PATENT DOCUMENTS

| | | | |
|---|---|---|---|
| 908382 | 8/1972 | Canada | 52/71 |
| 2048512 | 4/1971 | Fed. Rep. of Germany | 52/69 |
| 910960 | 3/1982 | U.S.S.R. . | |
| 208745 | 2/1982 | United Kingdom . | |

*Primary Examiner*—James L. Ridgill, Jr.
*Attorney, Agent, or Firm*—Seidel, Gonda, Lavorgna & Monaco

[57] ABSTRACT

A dormer structure is provided for a prefabricated modular housing unit. The dormer structure is collapsible so that the modular unit including a first and second floor may be shipped by tractor trailer. The collapsible dormer unit includes a vertical side wall which is pivotably attached to the base unit. A roofing structure is provided as a separate element and is secured onto the base unit during shipment. The collar ties used to support the roof of the house, upon assembly, are secured to the dormer roof structure for strengthening the structure during lifting and shipment. The dormer unit may form one-half of a second story of a house or may be attached to an angled roof portion on the second module of the house.

6 Claims, 5 Drawing Sheets

PREFABRICATED MODULAR HOUSING UNIT HAVING A COLLASIBLE DORMER

FIELD OF THE INVENTION

The present invention relates to prefabricated houses which are formed from modular units, assembled in one location and shipped to the housing site for final construction. The present invention particularly relates to a second story or dormer structure which forms a part of the housing unit module.

BACKGROUND OF THE INVENTION

The modular units of the present invention are contemplated for shipment by tractor trailer or the like from the assembly plant. In this type shipment, the units must meet the width, height, length and weight limitations for the roadways on which they are to travel. Such limitations typically require the unit to be less than approximately fourteen (14) feet high, less than fourteen (14) feet wide and no greater than sixty (60) feet long. Under these limitations, a dormer or second story structure typically cannot be included during shipment as part of the module.

It is known to include a collapsible roof structure which is pivotally secured to the base module and which, when assembled, forms one-half of the A-frame roof. However, housing units having a second story which provide either a dormer type room or a complete second floor typically require a separate module to be added on top of the base unit. This results in shipments of multiple modules to complete a house. Also, typical second story modules include separate floor joists which rest on the ceiling joists of the base unit. Manifestly, the two joist structures are repetitive in defining the first and second floor and significantly add to the overall housing cost.

BRIEF SUMMARY OF THE INVENTION

The present invention relates to a prefabricated modular housing unit which includes a collapsible dormer and/or second story thereon. The present invention also relates to a method of assembling the dormer or second story as part of the final assembly of the house.

The module unit of the present invention includes a pivotable vertical side wall (or walls) which form at least a portion of a second story room on the house. A preformed roof structure is assembled and shipped along with this base module. The dormer unit is collapsed such that the side wall(s) fold downwardly on top of the base unit. The roof structure is separably attached on top of the collapsed portions.

During assembly, the roofing structure is removed upon reaching the building site. Thereafter, the vertical side walls are positioned into place. The roofing structure is then lifted onto the house, being supported by the raised side walls. The dormer roof is joined at the top with another roof structure on a second module of the house to form an A-frame. The second module may have a matching dormer unit or be an angled roof element. Collar ties may be included as part of the assembly so as to support the roofing structure for the dormer and the roof element on the opposite module of the house. The collar ties may also be bundled together and attached to the completed roofing structure for the dormer to support the structure during assembly and shipment.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
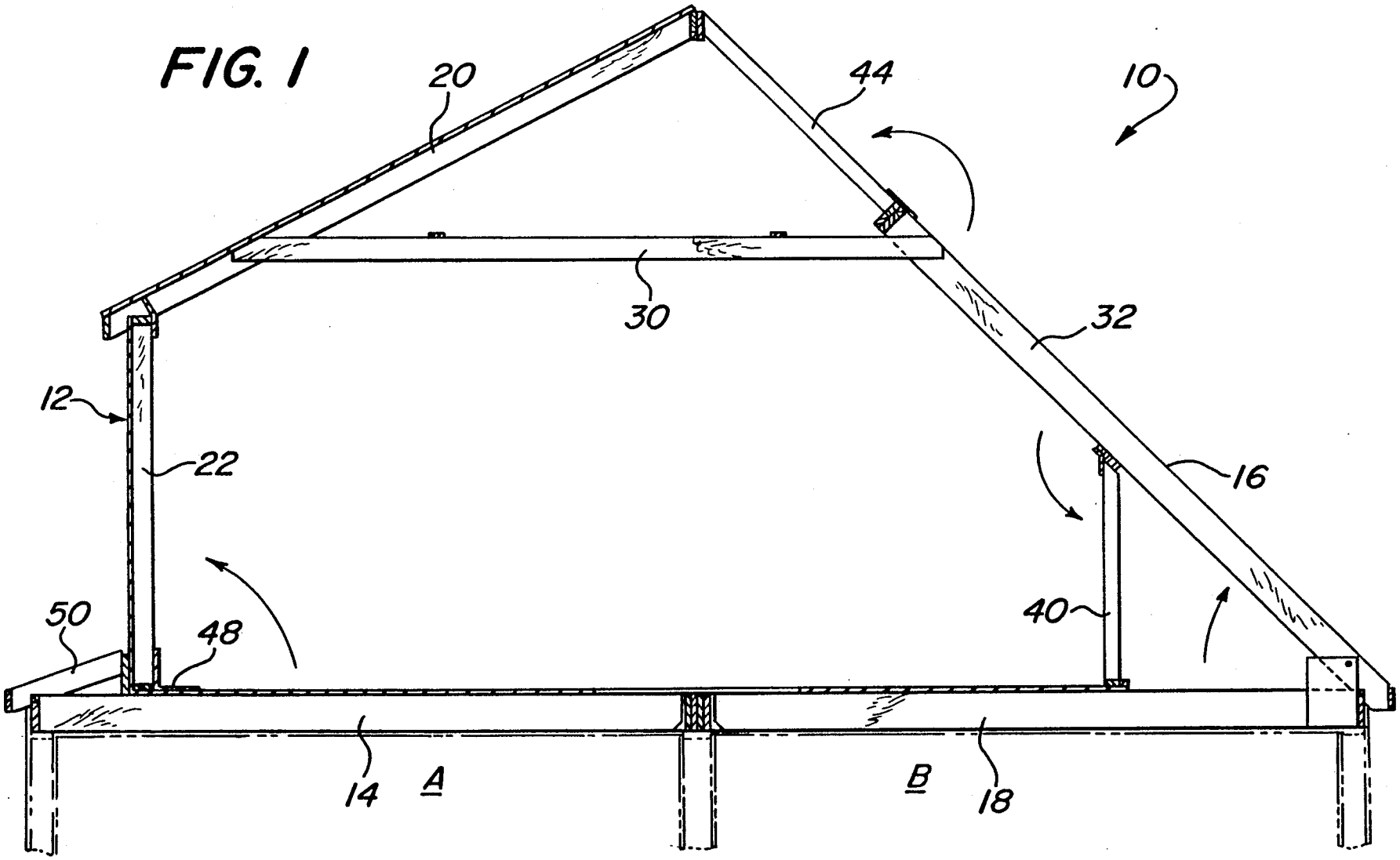
FIG. 1 shows a cross-sectional view of an assembled prefabricated modular house having a collapsible dormer thereon.

In the drawings were like numerals indicate like elements there is illustrated a portion of a housing unit which is generally referred to by the numeral 10. Housing unit 10 includes modules A and B which are prefabricated, being formed typically in a manufacturing facility or the like. Modules A and B are shipped separately and assembled together at the housing site to form the housing unit 10.

As illustrated in FIG. 1, module A includes a dormer type structure 12 forming a second story on the base unit 14. Module B generally includes a base unit 18 having an angled roof structure 16 thereon. Dormer 12 and angled roof 16 combine to form a dormer type room on the second story of the housing unit 10. The dormer of the present invention is to be distinguished from a dormer window unit which typically includes only a gabled window frame that projects from an angled roof. In the present invention, the dormer unit is contemplated to form a second story room or major portion thereof defining an area below the roof 20 and the angled roof structure 16.

Figure 2:
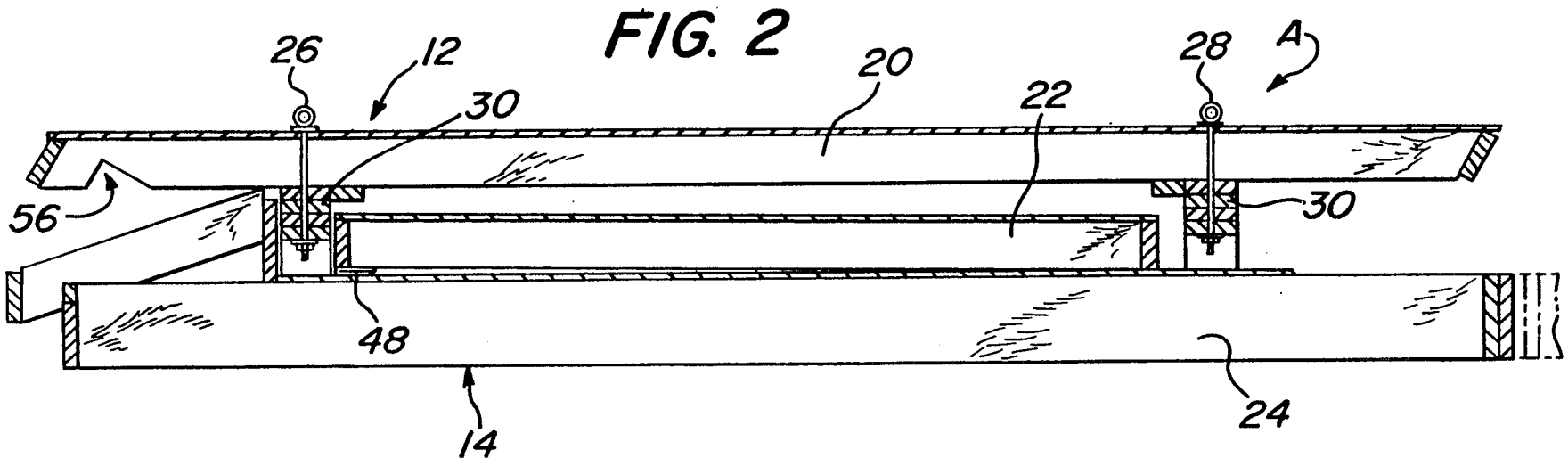
FIG. 2 shows a cross-sectional view of the collapsible dormer portion of a module unit in its shipment condition.

In FIG. 2 there is illustrated the dormer structure 12 attached to the base unit 14 in its collapsed or shipment condition. Roof structure 20 for the dormer 12 is positioned on top of the base unit 14 with the vertical side wall 22 collapsed into contact with the ceiling joists 24 of base unit 14. Eye bolts 26 and 28 are inserted through the dormer roof 20 and secure collar ties 30 thereto. This attachment of the collar ties 30 to the roof structure 20 is utilized to strengthen the roof during shipment and during assembly of the dormer 12.

Figure 3:
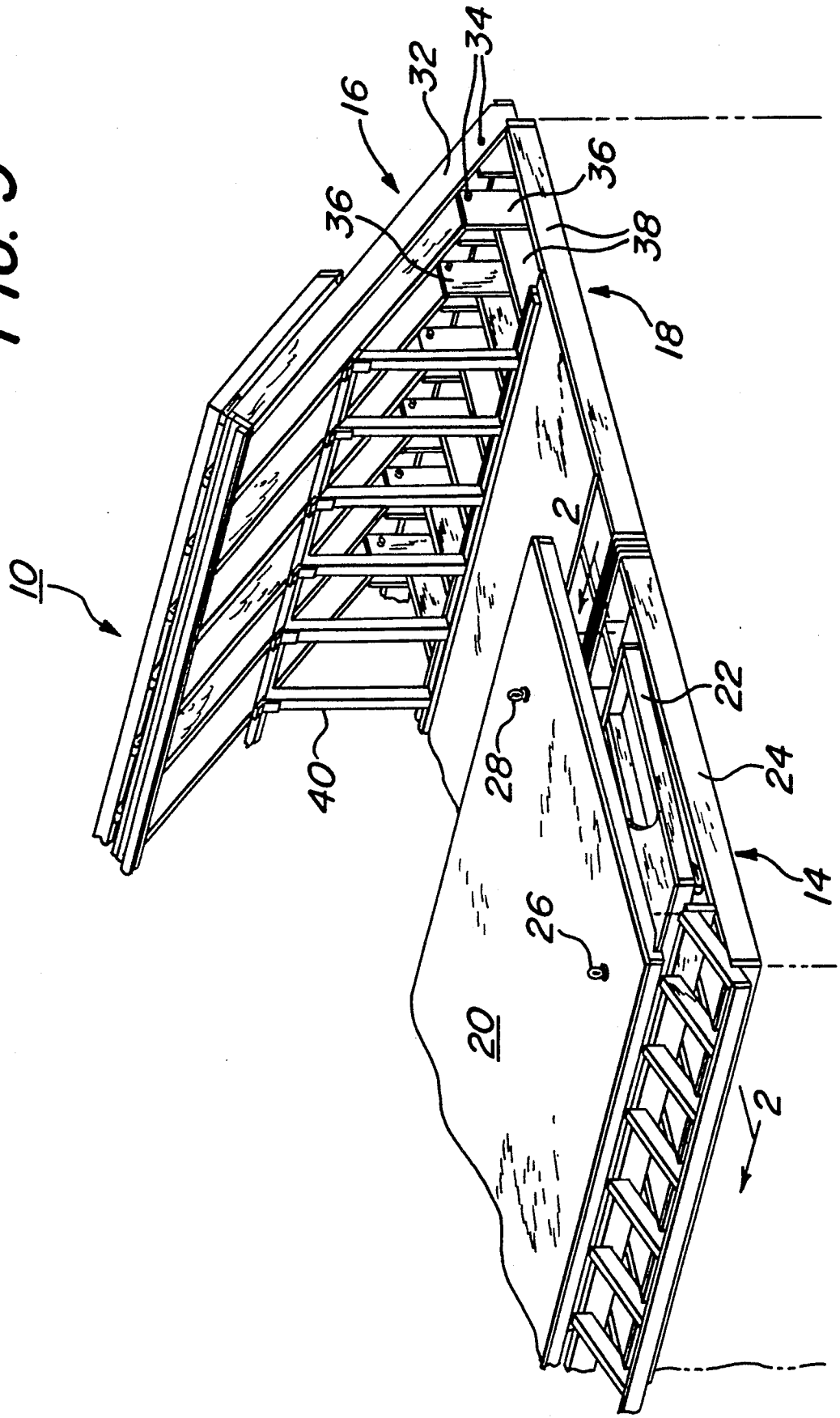
FIG. 3 shows a perspective view of the assembly of an angled roof portion on one of the module units.
Figure 4:
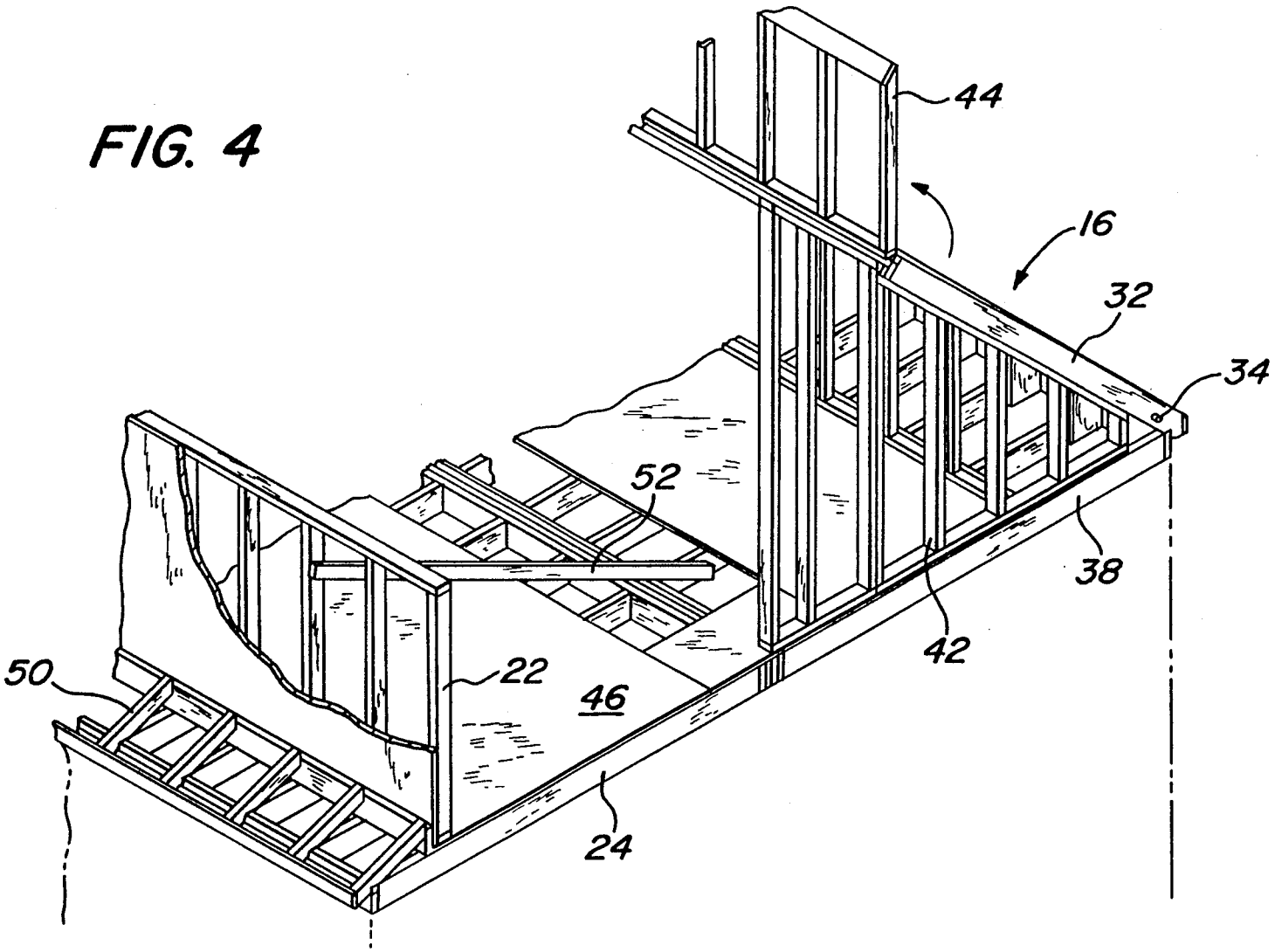
FIG. 4 shows a second perspective view of the assembly of the dormer unit and the angled roof portion forming the second story of the house.
Figure 5:
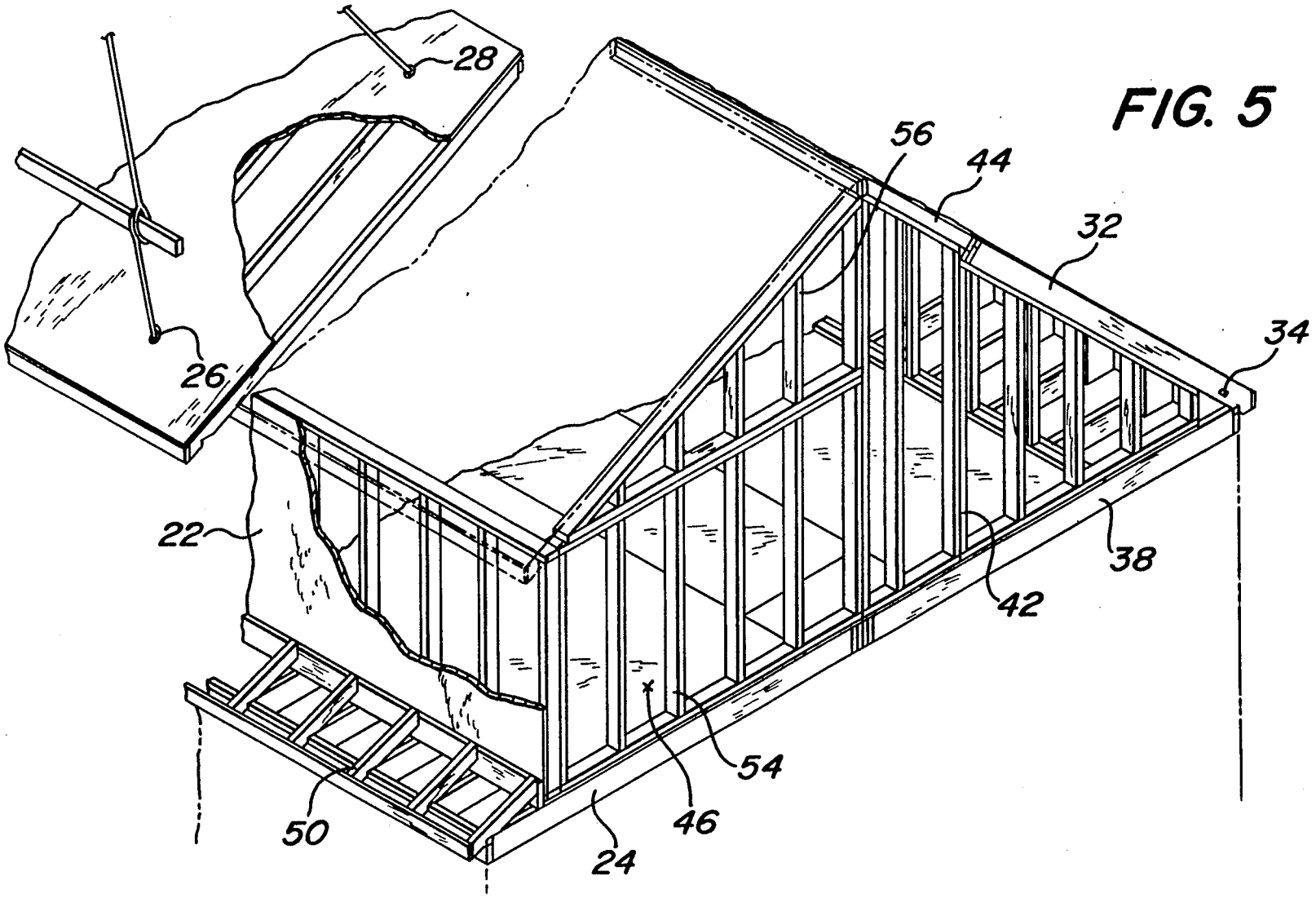
FIG. 5 shows a third perspective view of the assembly process of the second story of the house.

In FIGS. 3–5 there is shown the assembly method for the second story of the housing unit 10. It is contemplated that the dormer 12 will be shipped in the condition shown in FIG. 2. In addition, angled roof structure 16 will also be collapsed on the top of module B during shipment. However, the assembly method for angled roofing structure 16 as shown does not form a part of the present invention other than its contribution to forming the second story room along with the collapsible dormer 12.

In FIG. 3 there is illustrated the initial assembly of the housing unit 10 at the building site. Initial assembly requires the attachment of module A to module B so as to form an integrated base structure. Thereafter, angled roof structure 16 is elevated by pivoting roof portion 32 about the pivot formed on the ceiling joists 38 for base unit 18. The pivot is formed by bolts 34 which extend through the studs of roof portion 32 and through a series of gussets 36 attached to the ceiling joists 38. A support frame 40 is positioned between the ceiling joists 38 and the underside of the roof portion 32. Support frame 40 is secured to the ceiling joists 38 and roof portion 32 to maintain the angled position of roof portion 32 with respect to the base unit 18. Support frame 40 may be attached to the underside of roof structure 32 as well as the ceiling joists 38 by toe nails or the like. Support frame 40 may also be pivotably attached so as to be collapsible along with the roof portion 32 during shipment of module B.

As illustrated in FIG. 4, further assembly of the angled roofing structure 16 includes the pivoting of extension roof portion 44 from the top of roof portion 32. In addition, side walls 42 are added to further support the angled roof 16. The side walls 42 may be preformed and shipped inside of the base unit 18.

As also illustrated in FIG. 4, the assembly of the dormer 12 includes pivoting vertical side wall 22 about its attachment to the ceiling joists 24 of base unit 14. As illustrated in FIG. 1, side wall 22 is pivotably attached to the base unit 14 by straps 48. These straps 48 may be pivotable hinges or may be flexible metal strips. Each of the studs of the side wall 22 can be fixedly attached to flooring 46 on joists 24. When pivoted, side wall 22 directly abuts with the eave portion 50 provided on the front of module A. This eave portion 50 is optional. As illustrated in FIG. 4, the vertical side wall 22 may be supported by support brace 52 during attachment of the roof portion 20 thereon.

In order for the vertical side wall 22 to be placed in the position shown in FIG. 4, the roof portion 20 must be removed from the top of the base unit 14 (see FIGS. 2 and 3). Removal, and subsequent replacement of the roof portion 20 requires a crane or the like. Cables are secured to eye bolts 26 and 28 to facilitate lifting. The cable support for the roof structure 20 is generally illustrated in FIG. 5. Collar ties 30, as illustrated in FIG. 2, serve to support the roof during lifting. After the roof 20 is attached to angled roof 16 and side wall 22, the collar ties 30 are removed from roof element 20 and are used to support the roof of the house 10 by forming ceiling joists. Since the dormer 12 of the present invention is generally contemplated to extend for essentially the entire length of the house, or substantially the entire length of module A, the collar ties 30 serve to stiffen this roofing structure to prevent collapse under its own weight during lifting and to prevent bowing or damage during shipment.

Figure 6:
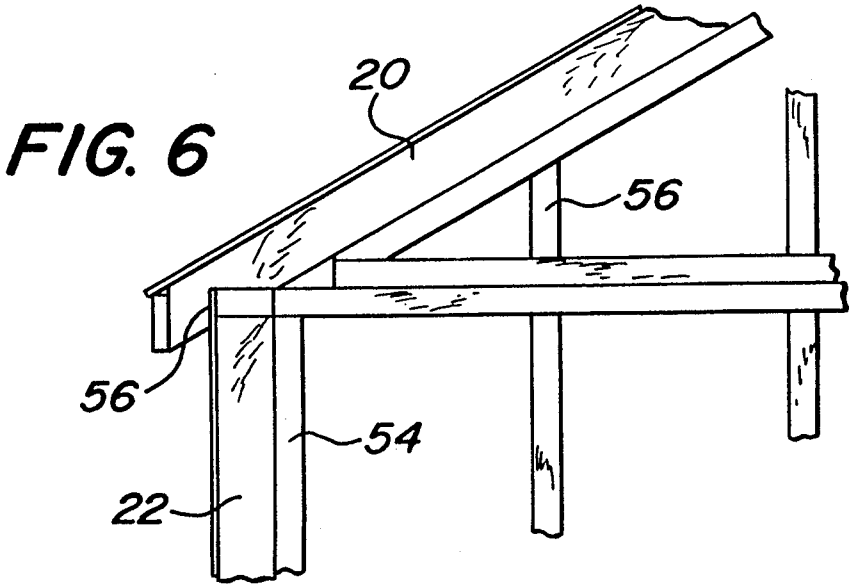
FIG. 6 shows a partial cross-sectional view of the attachment of the roof structure of the dormer unit to the vertical side walls thereof.

Prior to placement of the roof 20 onto the housing unit 10, side wall portions 54 and 56 are included to enclose the dormer 12. These structures further support the roof 20 upon its placement on top of the housing unit 10. As illustrated in FIG. 6, the roof 20 includes notches 56 which engage the top of the vertical side wall 22 upon placement thereon. Upon final assembly, the housing unit 10 may be completed in a known manner.

As illustrated, the dormer unit is included on a single base module. It is contemplated that a dormer type unit may be included on each module so as to provide a complete two story house. This modification would only require module B to be in a form similar to module A, only in mirror image. In addition, eave portion 50 may be removed or enlarged to vary the size of the second story room. This modification may require the angle of roof portion 20 to change so that the width of the roof does not exceed the fourteen (14) foot shipment limitation when the dormer 12 is collapsed.

The present invention may be embodied in other specific forms without departing from the spirit or essential attributes thereof and, accordingly, reference should be made to the appended claims, rather than to the foregoing specification, as indicating the scope of the invention.

We claim:

1. In a prefabricated housing formed by a series of engaging modules, a module comprising: (a) a base structure forming at least a portion of at least one floor of the housing unit, (b) a collapsible dormer structure forming at least a portion of an additional floor on top of the base, the collapsible dormer in the collapsed condition conforming to the dimensions of the base, the dormer comprising (i) at least one vertical side wall pivotally attached to the base and (ii) separable roofing means forming a portion of an angled roof for the module, the roofing means in the collapsed condition of the dormer conforming to the dimensions of the base, the roofing means being attached to the pivoted side wall of the dormer upon the side wall being pivoted to the substantially vertical position.

2. The housing unit module as claimed in claim 1 further comprising vertical side walls at each end of the dormer for attachment to the pivotable vertical side wall and for supporting the roofing means.

3. The housing unit modules claimed in claim 1, further comprising collar tie means securing the roofing means in the collapsed condition of the dormer and supporting the roofing means upon attachment to the side wall.

4. A method of assembling a prefabricated modular housing unit comprising the steps of: (a) providing a first module unit having a base structure, (b) assembling a dormer second floor structure on the base structure of the first module, the dormer having at least a vertical side wall and a separable roof, (c) collapsing the dormer structure, (d) conforming the collapsed dormer structure to the dimensions of the base structure by pivotably folding the vertical side wall on top of the base and by placing the roof structure flat on top of the first module, module unit having a base structure, (f) providing a roof structure for the section module unit, (g) collapsing the roof structure on the second module, (h) shipping the two module units to the building site, (i) joining the two module units to form an integrated base structure, (j) removing the separable dormer roof structure from the first module unit, (k) pivoting the folded side wall to a vertical position, (l) attaching the roof structure for the second module unit, and (m) attaching the separable dormer roof structure at one end to the pivoted vertical side wall and at the other end joining the roof structure for the first module unit with the roof structure for the second module unit to form an A-frame.

5. A method of assembly as claimed in claim 4, further comprising the steps of (a) providing a series of collar ties for the combined first modular unit roofing structure and second modular unit roofing structure, (b) securing the collar ties to the roofing structure for the first modular unit prior to shipment thereof for strengthening the roofing structure during shipment and during removal and assembly, and (c) securing the collar ties at opposite ends to the roofing structure for the first modular unit and the roofing structure for the second modular unit.

6. A method of assembly as claimed in claim 5, further comprising the steps of pivotably securing the roof structure for the second module unit to the base of the second module unit and pivoting the roof structure of the second module unit to form a continuous surface from its attachment with the base structure to its attachment to the separable dormer roof structure at the apex of the A-frame.

* * * * *